US012532907B2

(12) United States Patent
Besso et al.

(10) Patent No.: US 12,532,907 B2
(45) Date of Patent: Jan. 27, 2026

(54) HYDROPHOBIC PLUG WRAP

(71) Applicant: PHILIP MORRIS PRODUCTS S.A., Neuchatel (CH)

(72) Inventors: Clement Besso, Neuchatel (CH); Aurelien Guyard, Pompaples (CH); Alen Kadiric, Orpund (CH)

(73) Assignee: Philip Morris Products S.A., Neuchâtel (CH)

( * ) Notice: Subject to any disclaimer, the term of this patent is extended or adjusted under 35 U.S.C. 154(b) by 841 days.

(21) Appl. No.: 17/884,952

(22) Filed: Aug. 10, 2022

(65) Prior Publication Data

US 2022/0378087 A1 Dec. 1, 2022

Related U.S. Application Data

(62) Division of application No. 15/030,956, filed as application No. PCT/IB2015/057944 on Oct. 15, 2015, now Pat. No. 11,439,177.

(60) Provisional application No. 62/066,063, filed on Oct. 20, 2014.

(51) Int. Cl.

| | |
|---|---|
| ***A24D 1/02*** | (2006.01) |
| ***A24D 3/06*** | (2006.01) |
| ***D21H 17/11*** | (2006.01) |
| ***D21H 21/16*** | (2006.01) |

(52) U.S. Cl.

CPC ..... *A24D 1/02* (2013.01); *A24D 3/061* (2013.01); *D21H 17/11* (2013.01); *D21H 21/16* (2013.01)

(58) Field of Classification Search

None

See application file for complete search history.

(56) References Cited

U.S. PATENT DOCUMENTS

| | | | |
|---|---|---|---|
| 3,339,557 | A | 9/1967 | Karalus |
| 4,107,426 | A | 8/1978 | Gordon |
| 4,341,228 | A | 7/1982 | Keritsis et al. |
| 5,374,335 | A | 12/1994 | Lindgren et al. |
| 5,584,306 | A | 12/1996 | Beauman et al. |
| 5,724,998 | A | 3/1998 | Gellatly et al. |
| 6,216,706 | B1 | 4/2001 | Kumar et al. |
| 6,305,382 | B1 | 10/2001 | Hampl, Jr. |
| 6,342,268 | B1 | 1/2002 | Samain |
| 7,270,727 | B2 | 9/2007 | Varnell |
| 8,066,011 | B2 | 11/2011 | Clark |
| 10,542,773 | B2 | 1/2020 | Guyard |

(Continued)

FOREIGN PATENT DOCUMENTS

| | | | |
|---|---|---|---|
| CN | 201722562 | U | 1/2011 |
| CN | 102613702 | A | 8/2012 |

(Continued)

OTHER PUBLICATIONS

International Search Report and Written Opinion for PCT-IB2015-057944, issued by the European Patent Office, 11 pgs.

(Continued)

*Primary Examiner* — Michael J Felton

(74) *Attorney, Agent, or Firm* — Mueting Raasch Group

(57) ABSTRACT

A smoking article includes a tobacco substrate and a filter segment comprising filtration material axially aligned in an abutting end to end relationship with the tobacco substrate. A hydrophobic plug wrap is disposed about the filtration material. The plug wrap is hydrophobic via hydrophobic groups chemically bonded to the plug wrap.

18 Claims, 1 Drawing Sheet

(56) References Cited

U.S. PATENT DOCUMENTS

| | | | |
|---|---|---|---|
| 2002/0166563 | A1 | 11/2002 | Jupe |
| 2004/0159414 | A1 | 8/2004 | Durhammer |
| 2011/0232656 | A1 | 9/2011 | Zeng et al. |
| 2012/0325232 | A1 | 12/2012 | Yokogawa et al. |
| 2013/0112216 | A1 | 5/2013 | Clarke et al. |
| 2013/0167851 | A1 | 7/2013 | Ademe |
| 2013/0236647 | A1 | 9/2013 | Samain et al. |
| 2013/0345415 | A1 | 12/2013 | Trigiante |

FOREIGN PATENT DOCUMENTS

| | | | |
|---|---|---|---|
| EP | 2 740 370 | A1 | 6/2014 |
| GB | 1 483 495 | A | 8/1977 |
| JP | 2660947 | B2 | 10/1997 |
| JP | 2013-523420 | A | 6/2013 |
| KR | 10-2004-0034696 | A | 4/2004 |
| WO | WO 2011-114530 | A1 | 9/2011 |
| WO | WO 2011-116979 | A1 | 9/2011 |
| WO | WO 2014-064087 | A1 | 5/2014 |
| WO | WO 2014-086802 | A2 | 6/2014 |

OTHER PUBLICATIONS

International Preliminary Report on Patentability for PCT-IB2015-057944, issued by the International Bureau of WIPO, May 4, 2017; 7 pgs.

Communication of a Notice of Opposition from corresponding EP Patent Application—Patent No. 15794301.0-3086670, issued on Apr. 24, 2018, 24 pgs.

Japanese Office Action dated Dec. 23, 2019; issued by the Japanese Patent Office for related JP Application No. 2017-205783; 2 pgs.

Third Party Observation dated Dec. 18, 2019, received in connection to related JP Application No. 2017-205783; 25 pgs.

Guo et al., "Synthesis and Characterization of hydrophobic long-chain fatty acylated cellulose and its self-assembled nanoparticles," *Polymer Bulletin*, Aug. 2012; 69(4):389-403.

HYDROPHOBIC PLUG WRAP

This application is a divisional application of U.S. patent Ser. No. 15/030,956, filed 21 Apr. 2016, which is the § 371 U.S. National Stage of International Application No. PCT/IB2015/057944, filed 15 Oct. 2015, which claims the benefit of U.S. Provisional Application No. 62/066,063, filed 20 Oct. 2014, the disclosures of which are incorporated by reference herein in their entireties.

The present disclosure relates to materials used to make plug wrap in smoking articles.

Combustible smoking articles, such as cigarettes, typically comprise a cylindrical rod of tobacco cut filler surrounded by a wrapper and a cylindrical filter axially aligned in an abutting end-to-end relationship with the wrapped tobacco rod. The cylindrical filter typically comprises a filtration material circumscribed by a plug wrap. The wrapped tobacco rod and the filter are joined by a band of tipping wrapper, normally formed of a paper material that circumscribes the entire length of the filter and an adjacent portion of the wrapped tobacco rod. A cigarette is employed by a consumer by lighting one end thereof and burning the shredded tobacco rod. The smoker then receives mainstream smoke into their mouth by drawing on the mouth end or filter end of the cigarette.

Some smoking articles comprises an aerosol generating substrate containing tobacco which is heated rather than combusted when it is consumed. Known heated smoking articles include, for example, smoking articles in which an aerosol is generated by electrical heating or by the transfer of heat from a combustible fuel element or a heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco-containing material or other nicotine source, without combustion or heating, for example through a chemical reaction.

Many smoking articles include a filter with functional materials that capture or convert components of the mainstream smoke or aerosol as the mainstream smoke or aerosol is being drawn through the filter. Such functional materials are known and include, for example, sorbents, catalysts and flavourants. Certain flavourants used in smoking articles, such as menthol, are commonly provided in the form of liquid which is incorporated into the filter or the tobacco rod of the smoking article using a suitable liquid carrier. Liquid flavourants are often volatile and will therefore tend to migrate or evaporate from the smoking article during storage. The amount of flavourant available to flavour the mainstream smoke during smoking is therefore reduced.

It has previously been proposed to reduce the loss of volatile flavourants from smoking articles during storage through the encapsulation of the flavourant, for example, in the form of a capsule or microcapsule. The encapsulated flavourant can be released prior to or during smoking of the smoking article by breaking open the encapsulating structure, for example by crushing or melting the structure. The flavourants can be provided in a capsule which is adapted to release at least a portion of a fluid when the capsule is subjected to external force, such as squeezing, by the consumer. The released flavourants spread within the filter segment and contact the plug wrap.

Plug wrap made generally of plain paper absorbs liquid flavourant, humectant, water or any humidity or moisture surrounding the paper. The absorbed liquid stains or weakens the plug wrap and negatively affect the appearance and structural integrity of the smoking article. Smoking articles that comprise liquid flavour capsules are susceptible to wetting and breakage of the rod due to leakage of the liquid flavourant in transit to a consumer or when the flavour capsule is ruptured by the consumer. Heated smoking articles or aerosol-generating articles are particularly susceptible to wetting and breakage due to the high levels of humectant in the tobacco substrate of these heated smoking articles or aerosol-generating articles.

It would be desirable to provide a mechanically stable smoking article that can be utilized with a filter segment having a flavour capsule. It would be desirable to provide a smoking article that included plug wrap that did not readily absorb water or compounds found in the mainstream smoke or aerosol passing through the smoking article or liquid flavourant released from a flavour source activated within the filter segment. It would also be desirable that this hydrophobic plug wrap does not affect the taste of the smoke or aerosol generated by the smoking article.

According to a first aspect, a smoking article includes a tobacco substrate and a filter segment comprising filtration material axially aligned in an abutting end to end relationship with the tobacco substrate. Plug wrap is disposed about the filtration material. The plug wrap is hydrophobic via hydrophobic groups chemically bonded to the plug wrap.

In another aspect, the hydrophobic plug wrap is produced by a process comprising the steps of: applying a liquid composition comprising a fatty acid halide to at least one surface of a plug wrap, and maintaining the surface at a temperature of about 120° C. to about 180° C. The fatty acid halide reacts in situ with protogenic groups of material in the plug wrap resulting in the formation of fatty acid esters.

In a further aspect, a method for making hydrophobic plug wrap comprises the steps of: applying a liquid composition comprising a fatty acid halide to at least one surface of a plug wrap and maintaining the surface at a temperature of about 120° C. to about 180° C. The fatty acid halide reacts in situ with protogenic groups of material in the plug wrap resulting in the formation of fatty acid esters.

Smoking articles that include a hydrophobic plug wrap can reduce wetting and absorption of water or humectant in the mainstream smoke or aerosol passing through the smoking article, or a liquid composition flavourant released from a liquid release component ruptured within the filter segment. As a result, visible staining and physically weakening of the plug wrap portion of the smoking article may be reduced even when a liquid composition such as a liquid flavourant released from a liquid releasing component within the filter segment contacts the plug wrap.

Smoking articles in accordance with the present disclosure may be filter cigarettes or other smoking articles in which tobacco material is combusted to form smoke. For example, the aerosol-generating substrate may comprise a tobacco rod and the mouthpiece may comprise a filter. The paper wrapper may comprise a tipping wrapper joining the filter to the tobacco substrate or rod. The term "smoking article" is used herein to indicate cigarettes, cigars, cigarillos and other articles in which a smokable material, such as a tobacco, is lit and combusted to produce smoke. The term "smoking article" also includes an aerosol-generating article in which an aerosol comprising nicotine is generated by heat without combusting the aerosol-forming substrate, such as tobacco substrate.

Alternatively, smoking articles according to the present disclosure may be articles in which an aerosol-generating substance, such as tobacco, is heated to form an aerosol rather than combusted. In one type of heated smoking article, an aerosol generating substance is heated by one or more electrical heating elements to produce an aerosol. In another type of heated smoking article, an aerosol is produced by the transfer of heat from a combustible or chemical heat source to a physically separate aerosol generating substrate, which may be located within, around or downstream of the heat source. The present disclosure further encompasses smoking articles in which a nicotine-containing aerosol is generated from a tobacco material, tobacco extract, or other nicotine source, without combustion, and in some cases without heating, for example through a chemical reaction.

The term "aerosol-generating article" is used herein to refer to heated smoking articles or smoking articles that are not cigarettes, cigars, cigarillos, or that combust a tobacco substrate to produce smoke. Smoking articles according to the invention may be whole, assembled smoking devices or components of smoking devices that are combined with one or more other components in order to provide an assembled device for producing an aerosol, such as for example, the consumable part of a heated smoking device or aerosol-generating article.

Typically, an aerosol-generating device comprises: a heat source; an aerosol-forming substrate (such as a tobacco substrate); at least one air inlet downstream of the aerosol-forming substrate; and an airflow pathway extending between the at least one air inlet and the mouth-end of the article. The heat source is preferably upstream from the aerosol-forming substrate. In many embodiments the heat source is integral with the aerosol-generating device and a consumable aerosol-generating article is releasably received within the aerosol-generating device.

The heat source may be a combustible heat source, a chemical heat source, an electrical heat source, a heat sink or any combination thereof. The heat source may be an electrical heat source, preferably shaped in the form of a blade that can be inserted into the aerosol-forming substrate. Alternatively, the heat source may be configured to surround the aerosol-forming substrate, and as such may be in the form of a hollow cylinder, or any other such suitable form. Alternatively, the heat source is a combustible heat source. As used herein, a combustible heat source is a heat source that is itself combusted to generate heat during use, which unlike a cigarette, cigar or cigarillo, does not involve combusting the tobacco substrate in the smoking article. Preferably, such a combustible heat source comprises carbon and an ignition aid, such as a metal peroxide, superoxide, or nitrate, wherein the metal is an alkali metal or alkaline earth metal.

The terms "upstream" and "downstream" refer to relative positions of elements of the smoking article described in relation to the direction of mainstream smoke or aerosol as it is drawn from a tobacco substrate or aerosol-generating substrate and through the and mouthpiece.

The term "mainstream smoke" is used herein to indicate smoke produced by combustible smoking articles, such as cigarettes, and aerosols produced by non-combustible smoking articles as described above. Mainstream smoke flows through the smoking article and is consumed by the user.

The term "mouthpiece" is used herein to indicate the portion of the smoking article that is designed to be contacted with the mouth of the consumer. The mouthpiece can be the portion of the smoking article that can includes a filter, or in some cases the mouthpiece can be defined by the extent of the tipping paper. In other cases, the mouthpiece can be defined as a portion of the smoking article extending about 40 mm from the mouth end of the smoking article, or extending about 30 mm from the mouth end of the smoking article.

The mouthpiece of smoking articles in accordance with the present invention may comprise a filter including one or more filter segments of filtration material. For example, the mouthpiece may comprise a single segment of filtration material, or the mouthpiece may comprise a multi-segment filter including two or more segments of filtration material. Where two or more filter segments are provided, the filter segments may be of the same construction and materials as each other. Preferably, however, the filter segments have a different construction, and/or contain different filtration material to each other.

The term "plug wrap" is used herein to define a wrap which circumscribes only the mouthpiece or a portion of the mouthpiece. Where the mouthpiece is formed of a single segment, such as a single segment of filtration material, the plug wrap will circumscribe the single segment and will generally be the only material between the underlying segment and the tipping wrapper. Where the mouthpiece is formed of a set of multiple segments, the term "plug wrap" can refer to segment plug wraps which each circumscribe only a single segment or a sub-set of the segments, or the term can refer to a combining plug wrap which circumscribes all of the segments and any segment plug wraps. In this case, at least one of the segment plug wraps is preferably hydrophobic, and in some cases these plug wraps are formed from the same material or different material. The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation.

The present disclosure provides a hydrophobic plug wrap (that is, having only a hydrophobic inner surface or at least a hydrophobic inner surface, or having only a hydrophobic outer surface or at least a hydrophobic outer surface, or having both a hydrophobic inner surface and a hydrophobic outer surface) disposed about or surrounding filtration material.

It is contemplated that the hydrophobic plug wrap can reduce and prevent the formation of spots on a smoking article that are visible to a consumer. It has been observed that spots can appear on a smoking article upon storage or usage where flavour capsules leak or are ruptured. The spots can be caused by absorption of liquid flavourant or water or humectant, including any coloured substances that are suspended or dissolved, into the web of cellulosic fibers that constitutes the paper plug wrap. Without being bound by any theory, the flavourant, water or humectant interacts with the cellulosic fibers of the paper and alters the organization of the fibers resulting in a local change in the optical properties, such as brightness, color, and opacity, and mechanical properties, such as tensile strength, permeability of the paper plug wrap.

The plug wrap (or paper) is the portion of the smoking article that is disposed about the filtration material to help maintain the cylindrical form of the filter segment. This paper can exhibit a range of permeability or not be permeable. Permeability of cigarette paper is determined by utilizing the International Standard test method ISO 2965:2009 and the result is presented as cubic centimetres per minute per square centimetre and referred to as "CORESTA units".

In many embodiments, the permeability of the untreated wrapper (that is, with no hydrophobic treatment) can be in a range from 0 to 30,000 CORESTA units, or in a range from about 0 to 1,000 CORESTA units, or in a range from 0 to 100 CORESTA units, or in a range from about 0 to 10 CORESTA units, or in a range from 10 to 50 CORESTA units. In situ formation of the fatty acid esters (that is, hydrophobic treatment) with the plug wrap material reduces the permeability of the plug wrap by less than about 20%, or less than about 15%, or less than about 10% as compared to the permeability of the untreated wrapper described above.

Plug wrap can include ventilation elements such as a plurality of perforations. Perforations can be formed in the plug wrap at any stage of the manufacture process of the smoking article. The perforations can define one or more rows of voids or holes that circumscribe the smoking article. Preferable the perforations are placed at least 10 mm from the mouth end of the smoking article.

In various embodiments, the plug wrap can be formed of any suitable hydrophobic material. In many embodiments the plug wrap is formed of a material with pendent proteogenic groups. The term "protogenic" refers to a group that is able to donate a hydrogen or a proton in a chemical reaction. Preferably, the protogenic groups are reactive hydrophilic groups such as but not limited to a hydroxyl group (—OH), an amine group (—$NH_2$), or a sulfhydryl group (—$SH_2$). The invention will now be described, by way of example, with reference to wrappers comprising hydroxyl groups. Material with pendent hydroxyl groups includes cellulosic material such as paper, wood, textile, natural as well as artificial fibers. The plug wrap can also include one or more filler materials, for example calcium carbonate.

A plug wrap described herein, including any hydrophobic treatments, can have any suitable basis weight. The basis weight of a plug wrap can be in a range from about 10 to about 150 grams per square meter, from about 14 to about 115 grams per square meter, from about 30 to about 60 grams per square meter; from about 50 to about 90 grams per square meter; or from about 65 to about 85 grams per square meter. A plug wrap can have any suitable thickness. The thickness of a plug wrap can be in a range from about 25 to about 200 micrometres or from about 30 to about 100 micrometres, or from about 40 to 50 micrometres. In preferred embodiments, a single filter wrapper is provided and this single filter wrapper has a basis weight as set out above. Alternatively, in some embodiments, multiple filter wrappers may be provided, and the combined basis weight of the multiple wrappers may be the basis weight as set out above.

In many embodiments, the thickness of the plug wrap allows the hydrophobic groups or reagent applied to one surface to spread onto the opposing surface effectively providing similar hydrophobic properties to both opposing surfaces. In one example, the thickness of the plug wrap was about 43 micrometres and both surfaces were rendered hydrophobic by the gravure (printing) process using stearoyl chloride as the hydrophobic reagent to one surface. Accordingly, although many of the benefits of the invention only requires that one of the two major surfaces, that is, either the inner surface or the outer surface, exhibits the hydrophobic properties, it is contemplated that paper which exhibits hydrophobic properties on both major surfaces can also be used similarly. Therefore, the invention encompasses various applications in which the plug wrap comprises at least one hydrophobic surface.

The hydrophobic surface of a plug wrap can also inhibit the transfer, absorption and accumulation of flavourant, humectant, water and other dissolved or suspended substances to the plug wrap that can form visible spots on the plug wrap of smoking articles or weaken the plug wrap. Essentially, the hydrophobic surface reduces or prevents the staining of the plug wrap by water, flavourant, humectant and other dissolved or suspended substances.

The hydrophobic plug wrap can also inhibit the transfer, absorption and accumulation of flavourant, humectant, water and staining of the plug wrap that occurs when the smoking article is stored or utilized in a humid environment, particularly where the humidity is very high (e.g., relative humidity greater than 70%, 80%, 90%, 95%, 99%) or when the smoking article is stored for an extended period, (e.g., more than three weeks, two months, three months, or six months), or a combination of such conditions.

The hydrophobic nature of the plug wrap can also prevent or reduce the incidence of deformation or disintegration of the filter segment of a smoking article where moisture, flavourant, or humectant interacts with the plug wrap. When flavourant, humectant or water penetrates the plug wrap surface and is absorbed, the structure of the plug wrap is weakened, effectively lowering the tensile strength of the plug wrap and leading to easy tearing or collapse of the plug wrap or filter segment.

In some embodiments, the material or method to create the hydrophobic wrapper does not substantially affect the permeability of the plug wrap. Preferably, the reagent or method to create the hydrophobic plug wrap changes the permeability of the plug wrap (as compared to the untreated wrapper material) by less than about 10% or less than about 5%.

In various embodiments, the hydrophobic surface of the plug wrap has a Cobb water absorption (ISO535:1991) value (at 60 seconds) of less than about 30 $g/m^2$, less than about 20 $g/m^2$, less than about 15 $g/m^2$, or less than about 10 $g/m^2$.

In various embodiments, the hydrophobic surface of the plug wrap has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. Hydrophobicity is determined by utilizing the TAPPI T558 om-97 test and the result is presented as an interfacial contact angle and reported in "degrees" and can range from near zero degrees to near 180 degrees. Where no contact angle is specified along with the term hydrophobic, the water contact angle is at least 90 degrees.

In preferred embodiments, the inner surface of the plug wrap has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. The outer surface may be less hydrophobic than the inner surface in order to facilitate the subsequent processing of the outer surface, for example printing designs on the outer surface, printing treatments for reduced cigarette ignition propensity, or to make it more compatible with certain adhesives. In other embodiments, the outer surface has a water contact angle that is substantially the same as the inner surface, or within about 20 degrees of the contact angle of the inner surface.

The hydrophobic surface can be uniformly present along the length of the plug wrap. In some configurations the hydrophobic surface is not uniformly present along the length of the plug wrap. For example, the hydrophobic surface may be preferentially present on a portion of the plug wrap adjacent to the mouth piece of the smoking article and not present on an upstream portion of the plug wrap. In some embodiments, the hydrophobic surface is present adjacent to a flavourant capsule within the filter segment and not present upstream or downstream from the flavourant capsule. In some embodiments the hydrophobic surface forms a pattern along all or a portion of the length of the plug wrap.

In many embodiments the hydrophobic surface can be formed by printing reagent along the length of the plug wrap. Any useful printing methods can be utilized such as gravure, ink jet and the like. The reagent can include any useful hydrophobic groups that can be covalently bonded to the plug wrap material or pendent groups of the plug wrap material.

The hydrophobic surface can be formed with any suitable hydrophobic reagent or hydrophobic group. The hydrophobic reagent is preferably chemically bonded to the plug wrap or pendent protogenic groups of the plug wrap material. In many embodiments the hydrophobic reagent is covalently bonded to the plug wrap or pendent protogenic groups of the plug wrap material. For example, the hydrophobic group is covalently bonded to pendent hydroxyl groups of cellulosic material forming the plug wrap. A covalent bond between structural components of the plug wrap and the hydrophobic reagent can form hydrophobic groups that are more securely attached to the plug wrap material than simply disposing a coating of hydrophobic material on the plug wrap surface. By chemically bonding the hydrophobic reagent at the molecular level in situ rather than applying a layer of hydrophobic material in bulk to cover the surface allows the permeability of the plug wrap to be better maintained, since a coating tends to cover or block pores in the plug wrap and reduce the permeability. Chemically bonding hydrophobic groups to the plug wrap in situ can also reduce the amount of material required to render the surface of the plug wrap hydrophobic. The term "in situ" as used herein refers to the location of the chemical reaction which takes place on or near the surface of the solid material that forms the plug wrap, which is distinguishable from a reaction with cellulose dissolved in a solution. For example, the reaction takes place on or near the surface of paper which comprises cellulosic material in a heterogenous structure. However, the term "in situ" does not require that the chemical reaction takes place directly on a smoking article.

The hydrophobic reagent may comprises an acyl group or fatty acid group. The acyl group or fatty acid group or mixture thereof can be saturated or unsaturated. A fatty acid group (such as a fatty acid halide) in the reagent can react with pendent protogenic groups such as hydroxyl groups of the cellulosic material to form an ester bond covalently bonding the fatty acid to the cellulosic material. In essence, these reactions with the pendant hydroxyl groups can esterify the cellulosic material.

The acyl group or fatty acid group includes a $C_{12}$-$C_{30}$ alkyl (an alkyl group having from 12 to 30 carbon atoms), a $C_{14}$-$C_{24}$ alkyl (an alkyl group having from 14 to 24 carbon atoms) or preferably a $C_{16}$-$C_{20}$ alkyl (an alkyl group having from 16 to 20 carbon atoms). Those skill in the art would understand that the term "fatty acid" as used herein refers to long chain aliphatic, saturated or unsaturated fatty acid that comprises 12 to 30 carbon atoms, 14 to 24 carbon atoms, 16 to 20 carbon atoms or that has greater than 15, 16, 17, 18, 19, or 20 carbon atoms. In various embodiments, the hydrophobic reagent includes an acyl halide, a fatty acid halide, such as, a fatty acid chloride including palmitoyl chloride, stearoyl chloride or behenoyl chloride, a mixture thereof, for example. The in situ reaction between fatty acid chloride and cellulose in the wrapper results in fatty acid esters of cellulose and hydrochloric acid.

Any suitable method can be utilized to chemically bond the hydrophobic reagent or group to the plug wrap. As one example, an amount of hydrophobic reagent is deposited without solvent at the surface of paper at controlled temperature, for example, droplets of the reagents forming 20-micrometer regularly-spaced circles on the surface. The control of the vapour tension of the reagent can promote the propagation of the reaction by diffusion with the formation of ester bonds between fatty acid and cellulose while continuously withdrawing unreacted acid chloride. The esterification of cellulose is in some cases based on the reaction of alcohol groups or pendent hydroxyl groups of cellulose with an acyl halide, such as an acyl chloride including a fatty acid chloride. The temperature that can be used to heat the hydrophobic reagent depends on the chemical nature of the reagent and for fatty acid halides, it ranges from about 120° C. to about 180° C.

The hydrophobic reagent can be applied to the plug wrap in any useful amount or basis weight. In many embodiments the basis weight of the hydrophobic reagent is less than about 3 grams per square meter, less than about 2 grams per square meter, or less than about 1 gram per square meter or in a range from about 0.1 to about 3 grams per square meter, from about 0.1 to about 2 grams per square meter, or from about 0.1 to about 1 gram per square meter. The hydrophobic reagent can be applied or printed on the plug wrap surface and define a uniform or non-uniform pattern.

Preferably the hydrophobic plug wrap is formed by reacting a fatty acid ester group or a fatty acid group with pendent hydroxyl groups on the cellulosic material of the wrapper to form a hydrophobic surface of the plug wrap. The reacting step can be accomplished by applying a fatty acid halide (such as chloride, for example) which provides the fatty acid ester group or a fatty acid group to chemically bond with pendent hydroxyl groups on the cellulosic material of the plug wrap to form a hydrophobic surface of the wrapper. The applying step can be carried out by loading the fatty acid halide in liquid form onto a solid support, such as a brush, a roller, or an absorbent or non-absorbent pad, and then contacting the solid support with a surface of the wrapper. The fatty acid halide can also be applied by printing techniques, such as gravure, ink jet, flexography, heliography, by spraying, by wetting, or by immersion in a liquid comprising the fatty acid halide. The applying step can deposit discrete islands 61 of reagent forming a uniform or non-uniform pattern of hydrophobic areas on the surface of the plug wrap 60, as shown in FIG. 2. The uniform or non-uniform pattern of hydrophobic areas on the wrapper can be formed of at least about 100 discrete hydrophobic islands, at least about 500 discrete hydrophobic islands, at least about 1000 discrete hydrophobic islands, or at least about 5000 discrete hydrophobic islands. The discrete hydrophobic islands can have any useful shape such as a circle, rectangle or polygon. The discrete hydrophobic islands can have any useful average lateral dimension. In many embodiments the discrete hydrophobic islands have an average lateral dimension in a range from 5 to 100 micrometres, or in a range from 5 to 50 micrometres. To aid diffusion of the applied reagent on the surface, a gas stream can also be applied. Apparatus and processes such as those described in US patent publication 20130236647, incorporated herein by reference in its entirety, can be used to produce the hydrophobic plug wrap.

According to the invention, a hydrophobic plug wrap can be produced by a process comprising applying a liquid composition comprising a aliphatic acid halide to at least one surface of a plug wrap, optionally applying a gas stream to the surface to aid diffusion of the applied fatty acid halide, and maintaining the surface at a temperature about 120° C. to about 180° C., wherein the fatty acid halide reacts in situ with the hydroxyl groups of the cellulosic material in the plug wrap resulting in the formation of aliphatic acid esters. Preferably, the plug wrap is made of paper, and the fatty acid halide is stearoyl chloride, palmitoyl chloride, or a mixture of fatty acid chlorides with 16 to 20 carbon atoms in the acyl group. The hydrophobic plug wrap produced by a process described hereinabove is thus distinguishable from material made by coating the surface with a layer of pre-made fatty acid ester of cellulose.

The hydrophobic plug wrap is produced by a process of applying the liquid reagent composition to the at least one surface of a plug wrap paper at a rate of in a range from about 0.1 to about 3 grams per square meter, or from about 0.1 to about 2 grams per square meter, or from about 0.1 to about 1 gram per square meter. The liquid reagent applied at these rates renders the surface of a plug wrap paper hydrophobic.

Smoking articles, such as cigarettes and aerosol generating articles, include a tobacco substrate or an aerosol generating substrate that comprises a charge of tobacco surrounded by a wrapper. The tobacco substrate may comprise any suitable type or types of tobacco material or tobacco substitute, in any suitable form. Preferably, the tobacco rod includes flue-cured tobacco, Burley tobacco, Maryland tobacco, Oriental tobacco, specialty tobacco, or any combination thereof. Preferably, the tobacco is provided in the form of tobacco cut filler, tobacco lamina, processed tobacco materials, such as volume expanded or puffed tobacco, processed tobacco stems, such as cut-rolled or cut-puffed stems, homogenized tobacco, reconstituted tobacco, cast leaf tobacco, or blends thereof, and the like. The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

As used herein, the term "homogenized tobacco" denotes a rod or a sheet of material formed by agglomerating particulate tobacco by-products, such as tobacco fines, tobacco dusts, tobacco stems, or a mixture of the foregoing, and may include reconstituted tobacco, cast leaf tobacco, or both. The term "reconstituted tobacco" refers to a paper-like material that can be made from tobacco by-products by extracting the soluble chemicals in the tobacco by-products, processing the leftover tobacco fibers from the extraction into a paper-like sheet, and then reapplying the extracted materials in concentrated form onto the sheet. The term "cast leaf tobacco" refers to a paper-like material made by casting a slurry comprising particulate tobacco by-products and a binder (for example, guar) onto a supportive surface, such as a belt conveyor, drying the slurry and removing the dried sheet from the supportive surface. Exemplary methods for producing various types of homogenized tobacco are described in U.S. Pat. Nos. 5,724,998; 5,584,306; 4,341,228; 5,584,306 and 6,216,706.

The tobacco substrate or aerosol-generating substrate can include a high level of humectant material. Humectant material can be referred to as an "aerosol former". An aerosol former is used to describe any suitable known compound or mixture of compounds that, in use, facilitates formation of an aerosol and that is substantially resistant to thermal degradation at the operating temperature of the tobacco substrate or aerosol-generating substrate.

Suitable humectants or aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred humectants or aerosol formers are polyhydric alcohols or mixtures thereof, such as propylene glycol, triethylene glycol, 1,3-butanediol and, most preferred, glycerine. The tobacco substrate or aerosol-forming substrate may comprise a single humectant or aerosol former. Alternatively, the tobacco substrate or aerosol-generating substrate may comprise a combination of two or more humectants or aerosol formers.

In many embodiments, the tobacco substrate or aerosol-generating substrate has a humectant or aerosol former content of greater than about 10% or preferably greater than about 15% or more preferably greater than about 20%, on a dry weight basis. The tobacco substrate or aerosol-forming substrate has a humectant or aerosol former content of between about 10% and about 30%, or preferably from about 15% and about 30%, or more preferably from about 20% and about 30%, on a dry weight basis.

In embodiments in which the mouthpiece comprises two or more segments of filtration material, at least two segments of filtration material may be spaced apart to form a cavity therebetween. The cavity may be at least partially filled with a functional material.

In any of the embodiments in which the mouthpiece comprises one or more segments of filtration material, at least one of the filter segments may include a functional material. This may be in addition to any functional material provided in a cavity when present. The functional material, which can be a flavourant, is included to interact with and modify the characteristics of the smoking article, and thus the smoke derived therefrom. For example, a flavourant may impart a flavour to enhance the taste of the mainstream smoke produced during smoking. A flavourant is any natural or artificial compound that affects the organoleptic quality of a composition. A flavourant may impart a flavour to enhance the taste of mainstream smoke produced during smoking or the taste of an aerosol produced by an aerosol-generating substrate.

Many naturally occurring flavourants can be obtained either by extraction from a natural source or by chemical synthesis if the structure of the compound is known. The flavourants can be extracted from a part of a plant or an animal by physical means, by enzymes, or by water or an organic solvent, and thus include any extractive, essence, hydrolysate, distillate, or absolute thereof. Plants that can be used to provide flavourants, include but are not limited to, those belonging to the families, Lamiaceae (e.g., mints), Apiaceae (e.g., anise, fennel), Lauraceae (e.g., laurels, cinnamon, rosewood), Rutaceae (e.g., citrus fruits), Myrtaceae (e.g., anise myrtle), and Fabaceae (e.g., liquorice). Non-limiting examples of sources of flavourants include mints such as peppermint and spearmint, coffee, tea, cinnamon, clove, ginger, cocoa, vanilla, chocolate, *eucalyptus*, geranium, agave, and juniper.

Many flavourants are essential oils, or a mixture of one or more essential oils. An "essential oil" is an oil having the characteristic odour and flavour of the plant from which it is obtained. Suitable essential oils include, but are not limited to, eugenol, peppermint oil and spearmint oil. In many embodiments the flavourant comprises menthol, eugenol, or a combination of menthol and eugenol. In many embodiments, the flavourant further comprises anethole, linalool, or a combination of thereof. The term "herbaceous material" is used to denote material from an herbaceous plant. A "herbaceous plant" is an aromatic plant, the leaves or other parts of which are used for medicinal, culinary or aromatic purposes and are capable of releasing flavour into smoke produced by a smoking article. Herbaceous material includes herb leaf or other herbaceous material from herbaceous plants including, but not limited to, mints, such as peppermint and spearmint, lemon balm, basil, cinnamon, lemon basil, chive, coriander, lavender, sage, tea, thyme and caraway. The term "mints" is used to refer to plants of the genus *Mentha*. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens variegata*. In some embodiments, a flavourant can include tobacco material.

The flavourant may be provided directly onto a component of a filter. Alternatively, the flavourant may be provided as part of a flavourant delivery component that is configured to release the flavourant in response to a trigger mechanism. In some embodiments, the flavourant is a particulate flavourant material. Suitable particulate flavourant materials include particles of a sorbent or cellulosic material impregnated with a liquid flavourant.

The term "liquid release component" is used herein to refer to a discrete piece or portion of a liquid delivery material which is in a form that is suitable to be incorporated into a smoking article or aerosol-generating article. The liquid release component releases a liquid comprising a functional material. The liquid release component is preferably in the form of a bead, a capsule or a microcapsule. In preferred embodiments, the liquid release component is a flavourant delivery component for providing flavour in a smoking article. As used herein, the term "liquid" refers to compositions that are in a liquid state at room temperature, for example, 22° C.

In some embodiments, the flavourant is provided in a capsule which is adapted to release at least a portion of a liquid when the capsule is subjected to external force, such as squeezing, by the consumer. Thus, rupturing the capsule releases an amount of liquid flavourant into the filter segment or filtration material. The capsule can comprise an outer shell and an inner core containing the flavourant. Preferably, the outer shell is sealed before the application of an external force, but is frangible or breakable to allow the flavourant to be released when the external force is applied. The capsule may be formed in a variety of physical formations including, but not limited to, a single-part capsule, a multi-part capsule, a single-walled capsule, a multi-walled capsule, a large capsule, and a small capsule. Alternatively, the liquid flavourant is contained in a liquid releasing component which comprises a matrix structure defining a plurality of domains enclosing the liquid flavourant and which provides a sustained-release delivery profile, such that the amount of the flavour composition released upon compression of the flavour release component can be controlled through the adjustment of the compressive force applied by the consumer. Those of skill in the art will understand that the term "sustained release" covers those embodiments in which the amount of flavourant released at a given force depends additionally on the duration of the applied force.

According to the invention there is provided a smoking article comprising a hydrophobic plug wrap and incorporating at least one liquid release component. In one embodiment, the liquid release component is a capsule comprising an outer shell and an inner core that holds the liquid, and that the liquid is released when the capsule is ruptured by compression. In another embodiment, the liquid release component is formed of a sustained-release liquid delivery material. The liquid delivery material comprises a closed matrix structure having a polymer matrix defining a plurality of domains. The polymer matrix is formed of one or more polysaccharides cross-linked by multivalent cations. A liquid is trapped within the plurality of domains of the polymer matrix and is releasable from the closed matrix structure upon compression of the material.

In many embodiments the overall length of the smoking article is between about 70 mm and about 130 mm or is between about 30 mm and about 100 mm. In some embodiments the overall length of the smoking article is about 85 mm or about 45 mm. The external diameter of smoking article can be between about 5.0 mm and about 12 mm, or between about 5.0 mm and about 8 mm, or 7.2 mm±10%. The overall length of the filter of the smoking article can be between about 18 mm and about 36 mm. Accordingly, the overall length of the plug wrap used in the smoking article can be between about 18 mm and about 36 mm. In some embodiments the length of the plug wrap is about 27 mm.

Where the mouthpiece includes one or more segments of filtration material, the filtration material is preferably a plug of fibrous filtration material, such as cellulose acetate tow or paper. A filter plasticiser may be applied to the fibrous filtration material in a conventional manner, by spraying it onto the separated fibres, preferably before applying any particulate material to the filtration material. The mouthpiece may include a variety of different types of filter segments or combinations of filter segments, including those described above as well as other types of filter segments that would be known to the skilled person, such as segments including restrictors and segments that are used for adjusting the resistance to draw (RTD).

The resistance to draw (RTD) of the smoking articles and the filters of the present disclosure can vary. In many embodiments the RTD of the smoking article is between about 50 to 130 mm $H_2O$. The RTD of a smoking article refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation (if present) blocked.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Figure 1:
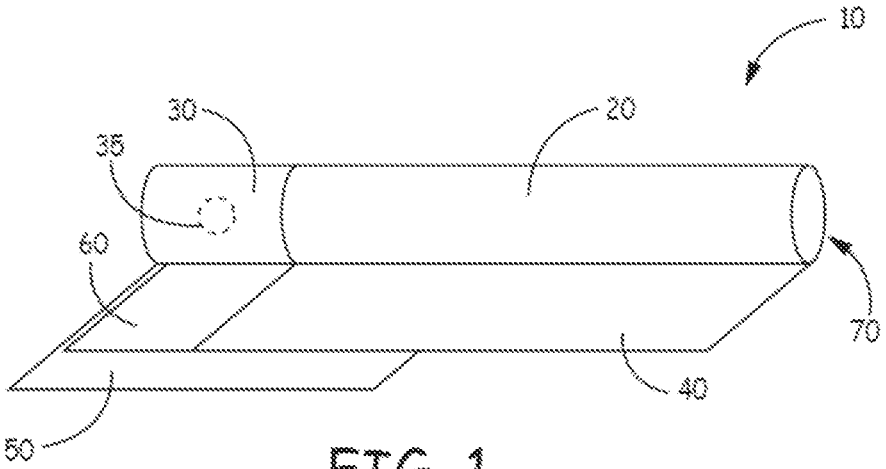
FIG. 1 is a schematic perspective view of an embodiment of a partially unrolled smoking article.
Figure 2:
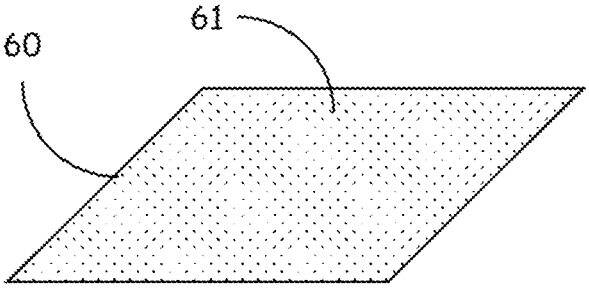
FIG. 2 is a schematic perspective view of a plug wrap.

The smoking articles depicted in FIG. 1 illustrates one or more embodiments of smoking articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

Referring now to FIG. 1, a smoking article 10 is depicted. The smoking article 10 includes a tobacco substrate 20, such as a tobacco rod, and a mouth end segment 30 and a lit end tip 70. The mouthpiece 30 can abut the tobacco substrate 20 in the finished smoking article 10. The depicted smoking article 10, includes a hydrophobic plug wrap 60 that circumscribes at least a portion of the filter or mouthpiece segment 30 and a wrapper 40 that circumscribes at least a portion of the tobacco substrate 20. A flavour capsule 35 is illustrated within the filter segment 30. Tipping paper 50 or other suitable wrapper circumscribes hydrophobic the plug wrap 60 and a portion of the wrapper 40.

The exemplary embodiments described above are not limiting. Other embodiments consistent with the exemplary embodiments described above will be apparent to those skilled in the art.

The invention claimed is:

1. A method for making hydrophobic plug wrap comprising: applying a liquid composition comprising a fatty acid halide to a surface of a plug wrap, maintaining the surface at a temperature of about 120° C. to about 180° C., wherein the fatty acid halide reacts in situ with protogenic groups of material in the plug wrap resulting in a formation of fatty acid esters, wherein the applying step comprises forming at least 100 discrete islands forming a pattern of hydrophobic area on the surface of the plug wrap, and the at least 100 discrete islands having an average lateral dimension of 5 μm to 100 μm.

2. The method according to claim 1, wherein the plug wrap is paper comprising cellulosic material which comprises hydroxyl groups that react in situ with stearoyl chloride or palmitoyl chloride.

3. The method according to claim 1, wherein the applying step comprises printing the liquid composition comprising a fatty acid halide on the surface of a plug wrap at a rate in a range from about 0.1 to about 3 grams per square meter to render the surface of a plug wrap paper hydrophobic.

4. The method according to claim 2, wherein the applying step comprises printing the liquid composition comprising a fatty acid halide on the surface of a plug wrap at a rate in a range from about 0.1 to about 3 grams per square meter to render the surface of a plug wrap paper hydrophobic.

5. The method according to claim 1, wherein the applying step comprises printing the liquid composition onto the surface of the plug wrap to form a pattern of hydrophobic area of at least 100 discrete islands having an average lateral dimension of 5 micrometres to 100 micrometres and form a hydrophobic surface.

6. The method according to claim 1, wherein the applying step comprises printing the liquid composition onto the surface of the plug wrap to form a pattern of hydrophobic area of at least 500 discrete islands having an average lateral dimension of 5 micrometres to 50 micrometres and form a hydrophobic surface.

7. The method according to claim 1, wherein the hydrophobic plug wrap exhibits a Cobb water absorption (ISO535:1991) value (60 s) of less than 20 $g/m^2$.

8. The method according to claim 1, wherein the hydrophobic plug wrap exhibits a water contact angle of at least about 100 degrees.

9. The method according to claim 1, wherein the applying step on one surface of the plug wrap forms a hydrophobic surface on an opposing surface from the one surface.

10. The method according to claim 1, further comprising wrapping the hydrophobic plug wrap about a segment of filtration material to form a wrapped plug of filtration material.

11. The method according to claim 10, wherein the filtration material comprises cellulose acetate tow.

12. The method according to claim 10, wherein the segment of filtration material comprises a liquid releasing component that contains a liquid flavourant.

13. The method according to claim 10, further comprising combining the wrapped plug of filtration material with an aerosol generating substrate.

14. The method according to claim 13, wherein the aerosol generating substrate comprises homogenized tobacco.

15. The method according to claim 13, wherein the aerosol generating substrate comprises at least 15% humectant.

16. The method according to claim 13, further comprising joining the aerosol generating substrate to the wrapped plug of filtration material with a tipping paper circumscribing the wrapped plug of filtration material.

17. The method according to claim 1, wherein the applying step comprises ink jet printing the liquid composition onto the surface of the plug wrap.

18. The method according to claim 1, wherein the applying step comprises gravure printing the liquid composition onto the surface of the plug wrap.

* * * * *